US008479494B2

(12) United States Patent
Enomoto et al.

(10) Patent No.: US 8,479,494 B2
(45) Date of Patent: Jul. 9, 2013

(54) EXHAUST GAS SENSOR CONTROL SYSTEM AND CONTROL METHOD

(75) Inventors: Hiroshi Enomoto, Toyota (JP); Akio Matsunaga, Miyoshi (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 386 days.

(21) Appl. No.: 12/808,571

(22) PCT Filed: Mar. 12, 2009

(86) PCT No.: PCT/IB2009/005060

§ 371 (c)(1),
(2), (4) Date: Jun. 16, 2010

(87) PCT Pub. No.: WO2009/112947

PCT Pub. Date: Sep. 17, 2009

(65) Prior Publication Data

US 2010/0300068 A1 Dec. 2, 2010

(30) Foreign Application Priority Data

Mar. 13, 2008 (JP) ..... 2008-064644
Mar. 24, 2008 (JP) ..... 2008-075675

(51) Int. Cl.
*F01N 11/00* (2006.01)

(52) U.S. Cl.
USPC ..... 60/276; 60/274; 73/114.72; 73/114.73

(58) Field of Classification Search
USPC ..... 60/274, 276; 73/114.69, 114.71, 73/114.72, 114.73
See application file for complete search history.

(56) References Cited

U.S. PATENT DOCUMENTS

| | | | | |
|---|---|---|---|---|
| 2006/0230748 | A1* | 10/2006 | Dalla Betta et al. | 60/286 |
| 2007/0000235 | A1* | 1/2007 | Ohsaki | 60/274 |
| 2007/0113539 | A1* | 5/2007 | Nakano | 60/276 |
| 2007/0204840 | A1* | 9/2007 | Abe | 123/697 |
| 2007/0214774 | A1* | 9/2007 | Higuchi | 60/285 |
| 2007/0271904 | A1 | 11/2007 | Shouda et al. | |

FOREIGN PATENT DOCUMENTS

| | | |
|---|---|---|
| JP | 2000 97902 | 4/2000 |
| JP | 2001 41923 | 2/2001 |
| JP | 2003 269231 | 9/2003 |
| JP | 2004-316594 A | 11/2004 |
| JP | 2004 360563 | 12/2004 |
| JP | 2006 220026 | 8/2006 |
| JP | 2006 299948 | 11/2006 |
| JP | 2007 10630 | 1/2007 |
| JP | 2007 138832 | 6/2007 |
| JP | 2008 14235 | 1/2008 |

* cited by examiner

*Primary Examiner* — Thomas Denion
*Assistant Examiner* — Jorge Leon, Jr.
(74) *Attorney, Agent, or Firm* — Oblon, Spivak, McClelland, Maier & Neustadt, L.L.P.

(57) ABSTRACT

In an exhaust gas sensor control system and control method, the exhaust pipe wall temperature is estimated based on the measured exhaust gas temperature measured, the exhaust gas flow rate, and the measured outside air temperature, with reference to a supplied heat quantity calculation map, wall temperature added value map, and a wall temperature subtracted value map. Then the dew-point of the exhaust pipe is calculated based on the air-fuel ratio of the air flow amount to the weight of fuel, and a condensed water added amount is calculated based on the relative wall temperature and the exhaust gas flow amount. The amount of condensed water is then estimated by summing the calculated condensed water added amounts.

14 Claims, 8 Drawing Sheets

EXHAUST GAS SENSOR CONTROL SYSTEM AND CONTROL METHOD

CROSS-REFERENCE TO PRIORITY APPLICATIONS

The disclosures of Japanese Patent Applications No. 2008-064644 filed on Mar. 13, 2008 and No. 2008-075675 filed on Mar. 24, 2008, including the specifications, drawings and abstracts are incorporated herein by references in their entireties.

BACKGROUND OF THE INVENTION

1. Field of the Invention

The invention relates to a control system and a control method for controlling an exhaust gas sensor provided in an exhaust pipe of an internal combustion engine.

2. Description of the Related Art

Conventionally, an exhaust gas sensor is provided in an exhaust pipe, or the like, of an engine installed on a vehicle. The exhaust gas sensor measures concentrations of exhaust gas (e.g. concentrations of oxygen for fuel) that passes through the exhaust pipe, and generates a voltage signal indicative of the measured concentration. An ECU (Electronic (or Engine) Control Unit) calculates the air-fuel ratio of the exhaust gas, based on the voltage output from the exhaust gas sensor, and controls the amount of air supplied to the engine and the weight of fuel injected into the engine, so that the calculated air-fuel ratio of the exhaust gas becomes equal to a target air-fuel ratio at which the exhaust gas is cleaned up with a catalyst.

The exhaust gas sensor is made of a material such as ceramic, and incorporates a heater because the sensor is not able to detect an exhaust gas component(s) until it reaches a certain temperature or higher and becomes activated. In operation, the exhaust gas sensor is activated by being heated with the heater. When the engine that has been cooled is started, water vapor in the exhaust gas may condense and collect in the exhaust pipe. If the condensed water collects in the exhaust pipe, it may spill on the exhaust gas sensor heated by the heater, and thereby damage the exhaust gas sensor.

In view of the above-described problem, Japanese Patent Application Publication No. 2004-360563 (JP-A-2004-360563) describes a system for detecting condensed water in the exhaust pipe, the system including a water trap portion in the form of a recess formed in the exhaust pipe through which exhaust gas flows, at a location downstream of the exhaust gas sensor, for trapping and storing water in the exhaust pipe, and water detecting means for detecting water stored in the recessed water trap portion. The water detecting means has a power supply and two electrodes, through which electric current flows when water collects in the water trap portion, and an ammeter that measures current that flows between the two electrodes. When condensed water is detected in the exhaust pipe, the system takes a suitable measure, for example, stops heating the exhaust gas sensor.

In the conventional exhaust gas sensor control system as described above, the water trap portion, two electrodes, power supply and ammeter need to be additionally provided for detecting condensed water in the exhaust pipe, and the provision of these components results in an increase in the manufacturing cost.

Also, an exhaust gas sensor control system (described in, for example, Japanese Patent Application Publication No. 2007-10630 (JP-A-2007-10630) includes a heater provided in the exhaust gas sensor, operating condition storing means for storing operation conditions of the engine during the last operation of the engine, liquid water presence determining means for determining whether condensed water from exhaust gas is present in the exhaust pipe when the engine is started this time, based on the stored operating conditions in the last engine operation, and heater control means for controlling preheating by energizing the heater when there is no condensed water.

However, the conventional exhaust gas sensor control system may encounter a situation where water droplets, formed from water contained in exhaust gas flowing from the engine into the exhaust gas sensor, condense on the exhaust gas sensor if the interior of the exhaust pipe is not dry, even if there is no condensed water of exhaust gas in the exhaust pipe. In this case, the exhaust gas sensor may be damaged if the sensor is rapidly heated. Also, if the exhaust pipe has a special structure that causes the temperature of exhaust gas to decrease by the time the exhaust gas reaches the exhaust gas sensor, for example, if there is a long distance from the engine to the exhaust gas sensor, or a component, such as a catalyst, is disposed between the engine and the exhaust gas sensor, water droplets are likely to condense on the exhaust gas sensor.

SUMMARY OF THE INVENTION

The present invention has been developed so as to solve the problems as described above, and provides exhaust gas sensor control system and control method which enhance the accuracy with which the presence or absence of condensed water arising in an exhaust pipe is determined, so as to surely prevent the exhaust gas sensor from being damaged, and also eliminate a need to provide an apparatus or equipment for measuring the amount of condensed water that collects in the exhaust pipe, to thus sufficiently reduce the manufacturing cost required for preventing damage to the exhaust gas sensor.

According to one aspect of the invention, there is provided an exhaust gas sensor control system for controlling an energized state of a heater that heats an exhaust gas sensor provided in an exhaust pipe of an internal combustion engine, which includes: an exhaust gas temperature sensor that detects an exhaust gas temperature of exhaust gas in the exhaust pipe, an air flow amount sensor that detects an amount of flow of air that is drawn into the internal combustion engine, an outside air temperature sensor that detects an outside air temperature, a condensed water amount estimating device that estimates an amount of condensed water that collects in the exhaust pipe, using the exhaust gas temperature measured by the exhaust gas temperature sensor when the internal combustion engine is started, the amount of air flow measured by the air flow amount sensor, and the outside air temperature measured by the outside air temperature sensor, a condensed water sensor that determines whether the amount of condensed water estimated by the condensed water amount estimating device is present in the exhaust pipe, and a heater control device that supplies electric current to the heater if the condensed water sensor determines that there is no condensed water.

According to another aspect of the invention, there is provided an exhaust gas sensor control method for controlling the energization of a heater that heats an exhaust gas sensor provided in an exhaust pipe of an internal combustion engine. This method includes the steps of: detecting an exhaust gas temperature of exhaust gas in the exhaust pipe, detecting an air flow amount that is drawn into the internal combustion engine, detecting an outside air temperature, estimating an amount of condensed water that collects in the exhaust pipe, using the exhaust gas temperature detected when the internal combustion engine is started, the detected amount of air flow, and the detected outside air temperature, determining whether the estimated amount of condensed water is present, and supplying electric current if it is determined that there is no condensed water.

According to the exhaust gas sensor control system and control method as described above, the amount of condensed water that collects in the exhaust pipe is estimated, using the exhaust gas temperature detected when the internal combustion engine is started, the air flow amount, and the outside air temperature, and whether the estimated amount of condensed water is present in the exhaust pipe is determined. Thus, since the heater is powered to heat the exhaust gas sensor when it is determined that there is no condensed water, using output values of an exhaust gas temperature sensor, air flow meter, and an outside air temperature sensor, which are generally provided in the internal combustion engine, there is no need to provide an apparatus for measuring the amount of condensed water present in the exhaust pipe, and the manufacturing cost required for preventing damage to the exhaust gas sensor can be sufficiently reduced.

In the exhaust gas sensor control system and control method as described above, it is preferable that an estimated wall temperature in the exhaust pipe, which is sequentially obtained using the exhaust gas temperature, the air flow amount and the outside air temperature, is calculated, while a dew-point of the exhaust pipe is calculated based on an air-fuel ratio as a ratio of the air flow amount to the weight of fuel, and a relative wall temperature is obtained from the calculated estimated wall temperature and the dew-point, and that a condensed water added amount is calculated based on the relative wall temperature and the air flow amount, and a value obtained by summing the calculated condensed water added amounts is estimated as the amount of condensed water.

According to the control system and control method as described above, the estimated wall temperature in the exhaust pipe, which is sequentially obtained using the exhaust gas temperature, the air flow amount and the outside air temperature, is calculated, while a dew-point of the exhaust pipe is calculated based on the air-fuel ratio as the ratio of the air flow amount to the weight of fuel, and a relative wall temperature is obtained from the calculated estimated wall temperature and the dew-point. Furthermore, the condensed water added amount is calculated based on the relative wall temperature and the air flow amount, and a value obtained by summing the calculated condensed water added amount is estimated as the amount of condensed water. Since the control system and method use output values received from the exhaust gas temperature sensor, air flow meter, and the outside air temperature sensor, which are generally provided in the internal combustion engine, there is no need to provide an apparatus or equipment for measuring the amount of condensed water that collects in the exhaust pipe, and the manufacturing cost associated with prevention of damage to the exhaust gas sensor can be sufficiently reduced.

In the exhaust gas sensor control system and control method as described above, it is preferable that the amount of condensed water present upstream of the exhaust gas sensor in the exhaust pipe is estimated, and whether the amount of condensed water estimated is present upstream of the exhaust gas sensor is determined. Furthermore, it is also preferable that the amounts of condensed water present upstream and downstream of the exhaust gas sensor in the exhaust pipe are estimated, and whether the amount of condensed water is present upstream of and downstream of the exhaust gas sensor is determined.

According to the control system and control method as described above, the amount of condensed water present upstream of the exhaust gas sensor, which has an influence on the exhaust gas sensor in ordinary running conditions of the vehicle, is estimated, and then whether the condensed water is present is determined. Since the heater is powered to heat the exhaust gas sensor when it is determined that there is no condensed water, the exhaust gas sensor is prevented from being damaged. In the case where the amounts of condensed water present upstream and downstream of the exhaust gas sensor in the exhaust pipe are estimated, and then whether the condensed water is present is determined, the accuracy with which the presence or absence of the condensed water is determined can be further enhanced, as compared with the case where the amount of condensed water present either upstream or downstream of the exhaust gas sensor is estimated, and the heater is powered to heat the exhaust gas sensor, based on the result of the determination, so that the exhaust gas sensor is surely prevented from being damaged.

In the exhaust gas sensor control system as described above, it is preferable that a dryness determining device is further provided for determining whether the interior of the exhaust pipe is dry, using the exhaust gas temperature, the detected amount of air flow, and the detected outside air temperature, when it is determined that there is no condensed water, and that the heater is controlled such that electric current is supplied to the heater when the dryness determining device determines that the interior of the exhaust pipe is dry. Also, it is preferable for the control method to include steps corresponding to the features as described above.

According to the control system and control method as described above, whether the condensed water is present in the exhaust pipe is determined, and it is further determined whether the interior of the exhaust pipe is dry if it is determined that there is no condensed water in the exhaust pipe, thus assuring improved accuracy with which the presence or absence of condensed water is determined. Since the heater is powered to heat the exhaust gas sensor, based on the above determinations, the exhaust gas sensor is surely or reliably prevented from being damaged.

In the exhaust gas sensor control system and control method as described above, it is preferable to determine that the interior of the exhaust pipe is dry if the quantity of heat supplied to the exhaust pipe, which is a sum of added quantity sequentially obtained using the exhaust gas temperature and the air flow amount, is larger than a dryness determination index obtained based on the outside air temperature and a predetermined heat capacity of the exhaust pipe.

According to the control system and control method as described above, it is determined that the interior of the exhaust pipe is dry if the quantity of heat supplied to the exhaust pipe, which is the sum of added quantity sequentially obtained using the exhaust gas temperature and the air flow amount, is larger than the dryness determination index obtained based on the outside air temperature and the predetermined heat capacity of the exhaust pipe. It is thus possible to easily determine whether the interior of the exhaust pipe is dry, because of the use of output values of the exhaust gas temperature sensor, air flow amount sensor and the outside air temperature sensor, which are generally provided in the internal combustion engine.

In the exhaust gas sensor control system and control method as described above, it is preferable to determine that the interior of the exhaust pipe is dry if an estimated wall temperature in the exhaust pipe, which is sequentially obtained using the exhaust gas temperature, the air flow amount, and the outside air temperature, is above a dew-point of the exhaust pipe, which is obtained based on an air-fuel ratio as a ratio of the air flow amount to the weight of fuel.

According to the control system and control method as described above, it is determined that the interior of the exhaust pipe is dry if the estimated wall temperature in the exhaust pipe (i.e. temperature of the exhaust pipe wall), which is sequentially obtained using the exhaust gas temperature, air flow amount, and the outside air temperature, is above the dew-point in the exhaust pipe, which is obtained based on the air-fuel ratio. Therefore, it can be accurately determined whether the exhaust pipe is dry, based on the dew-point.

In the exhaust gas sensor control system and control method, it is preferable that whether the condensed water that collects in a portion of the exhaust pipe upstream of the exhaust gas sensor is present is determined. It is further preferable that whether the condensed water that collects in the exhaust pipe upstream and downstream of the exhaust gas sensor is present is determined.

According to the control system and control method as described above, the amount of condensed water present upstream of the exhaust gas sensor, which has an influence on the exhaust gas sensor in ordinary running conditions, is estimated, and then whether the condensed water is present is determined. Since the heater is powered to heat the exhaust gas sensor when it is determined that there is no condensed water, the exhaust gas sensor is prevented from being damaged. In the case where whether the condensed water that collects in the exhaust pipe at locations upstream and downstream of the exhaust gas sensor is present is estimated, and it is then determined whether the interior of the exhaust pipe is dry if it is determined that there is no condensed water, the accuracy with which the presence of condensed water is determined can be further enhanced, as compared with the case where the amount of condensed water present either upstream or downstream of the exhaust gas sensor is measured or estimated, and the heater is powered to heat the exhaust gas sensor, based on the above determinations, so that the exhaust gas sensor is surely prevented from being damaged.

According to the present invention, there may be provided an exhaust gas sensor control system that determines the presence or absence of condensed water arising in the exhaust pipe with enhanced accuracy, and surely or reliably prevents the exhaust gas sensor from being damaged, while eliminating a need to provide an apparatus for measuring the amount of condensed water that collects in the exhaust pipe, to thus sufficiently reduce the manufacturing cost associated with prevention of damage to the exhaust gas sensor.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Some embodiments of the invention will be described with reference to the drawings.

Figure 1:
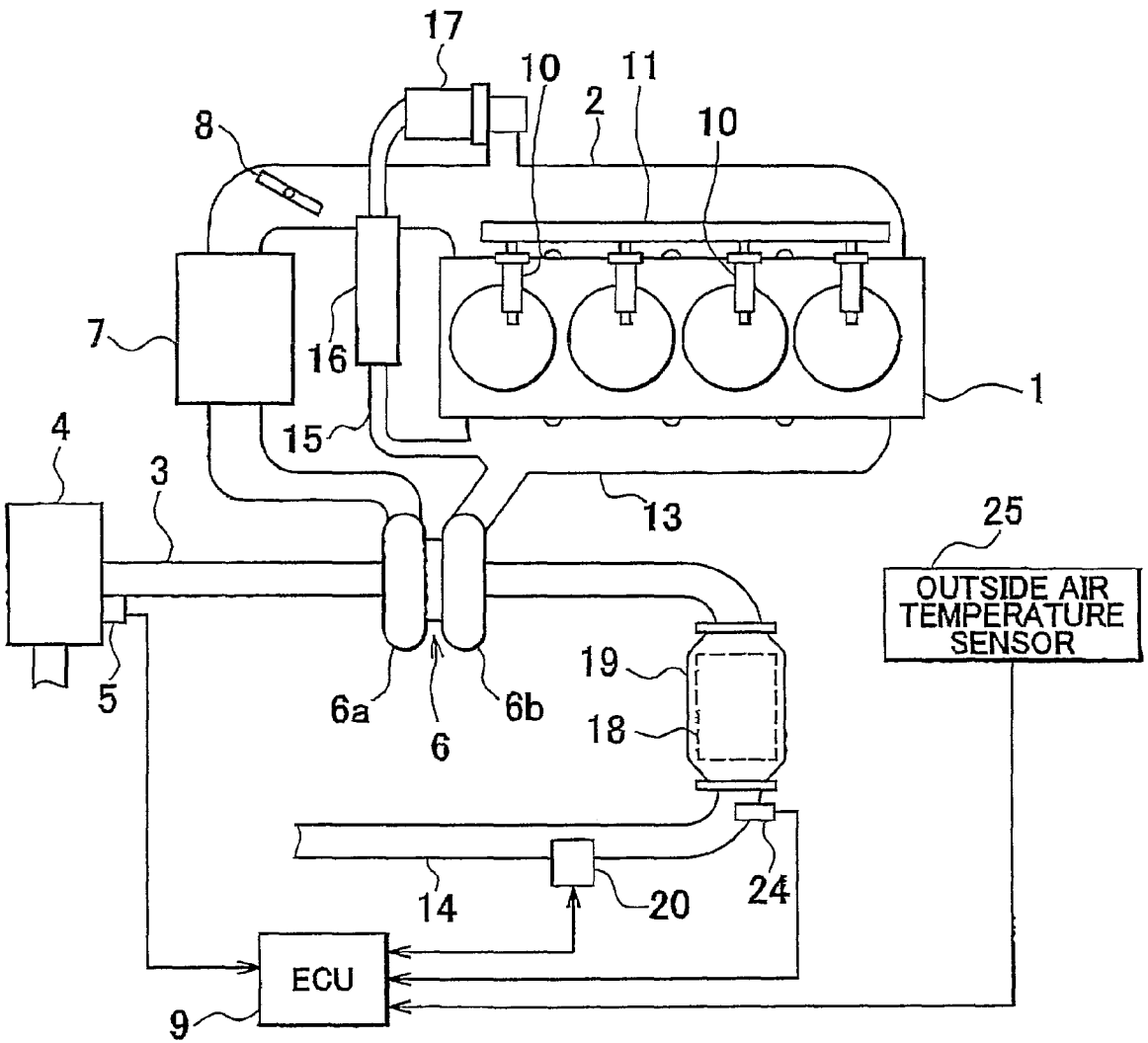
FIG. 1 is a schematic view of the general construction of an internal combustion engine of a vehicle and its control system according to a first embodiment of the invention.

Initially, a first embodiment of the invention will be described. FIG. 1 schematically shows the construction of an internal combustion engine of a vehicle and its control system according to the first embodiment of the invention. The construction of the engine and its control system will be first described.

In the embodiment of FIG. 1, the internal combustion engine to which the invention is applied is in the form of a diesel engine for driving a motor vehicle. In FIG. 1, the engine 1 is an in-line four-cylinder diesel engine, in which intake air is drawn into a combustion chamber of each cylinder, via an intake manifold 2 and an intake pipe 3. An air cleaner 4 is provided at the beginning or upstream end of the intake pipe 3, and an air flow meter (AFM) 5, compressor 6*a* of a turbocharger 6, intercooler 7 and a throttle valve 8 are provided in the intake pipe 3. While the invention is applied to the diesel engine for driving the vehicle, as one type of internal combustion engine, in this embodiment of the invention, the invention may also be applied to other types of internal combustion engines, such as a gasoline engine.

The air flow meter 5 generates an output signal indicative of the amount of new air flowing into the intake pipe 3 via the air cleaner 4, to an electronic control unit (ECU) 9 for controlling the engine, and the ECU 9 calculates the intake air amount based on the output signal of the air flow meter 5.

Into the combustion chamber of each cylinder of the engine 1, fuel is injected from a corresponding one of fuel injection valves 10. The fuel injection valves 10 are connected to a common rail 11, and fuel is supplied from a fuel pump (not shown) to the common rail 11. The valve-open timing and valve-open period of each fuel injection valve 10 and the amount of the fuel injected are controlled by the ECU 9, according to the operating conditions of the engine 1.

Exhaust gas produced in the combustion chamber of each cylinder of the engine 1 is discharged into the exhaust pipe 14 via an exhaust manifold 13, and then discharged to the atmosphere via a muffler (not shown). A portion of the exhaust gas discharged into the exhaust manifold 13 can be re-circulated into the intake manifold 2 via an exhaust circulation pipe 15, and an EGR cooler 16 and an EGR valve 17 are provided in the exhaust circulation pipe 15. In operation the ECU 9 controls the opening of the EGR valve 17, according to the operating conditions of the engine 1, so as to control the amount of the exhaust recirculated to the intake system.

A turbine 6*b* of the turbocharger 6, a casing 19 in which a DPF (Diesel Particulate Filter) 18 is housed, and an exhaust gas sensor 20 are provided in the exhaust pipe 14. The turbine 6*b*, which is driven by exhaust gas, is operable to increase the pressure of intake air by driving the compressor 6*a* coupled to the turbine 6*b*. The DPF 18 includes a filter element for trapping particulate matter (e.g., soot) contained in exhaust gas, and a storage-reduction type NOx catalyst loaded on the filter element. The DPF 18 traps the particulate matter in exhaust gas, and purifies exhaust gases of HC, CO, and NOx contained therein. The ECU 9 controls the exhaust gas sensor 20, according to the operating conditions of the engine 1. While the exhaust gas sensor 20 is in the form of an oxygen sensor in this embodiment of the invention, it is to be understood that the exhaust gas sensor of the invention is not limited to the oxygen sensor.

If the exhaust pipe 14 is designed such that the exhaust gas sensor 20 is placed at a location a long distance from the engine 1, or such that a component, such as a catalyst, is disposed between the engine 1 and the exhaust gas sensor 20, the temperature of exhaust gas is lowered by the time the exhaust gas reaches the exhaust gas sensor 20, and condensed water is likely to collect upstream of the exhaust gas sensor 20, or water droplets are likely to be deposited on the exhaust gas sensor 20 when it receives the exhaust air flowing from the engine 1. Accordingly, the ECU 9 is configured to control the heating of the exhaust gas sensor 20, which will be described later.

The exhaust gas sensor 20 has a sensor element and a heater 35 (see FIG. 2) that heats the sensor element to activate it. The exhaust gas sensor 20 measures the oxygen concentration in the exhaust gas flowing through the exhaust pipe 14, using the activated sensor element. The sensor element of the exhaust gas sensor 20 is made of ceramic, such as zirconia, and is able to detect oxygen when the sensor element is activated (i.e., at an activation temperature). Thus, the exhaust gas sensor 20 causes the heater 35 to heat the sensor element so as to increase the element temperature to several hundreds of degrees (° C.) where the element becomes active, and to maintain the sensor element at the activation temperature. Also, the exhaust gas sensor 20 is provided with protective covers with which a sensing portion of the sensor element is covered, and exhaust gas is introduced into the exhaust gas sensor 20 through small vent holes formed in the protective covers.

Figure 2:
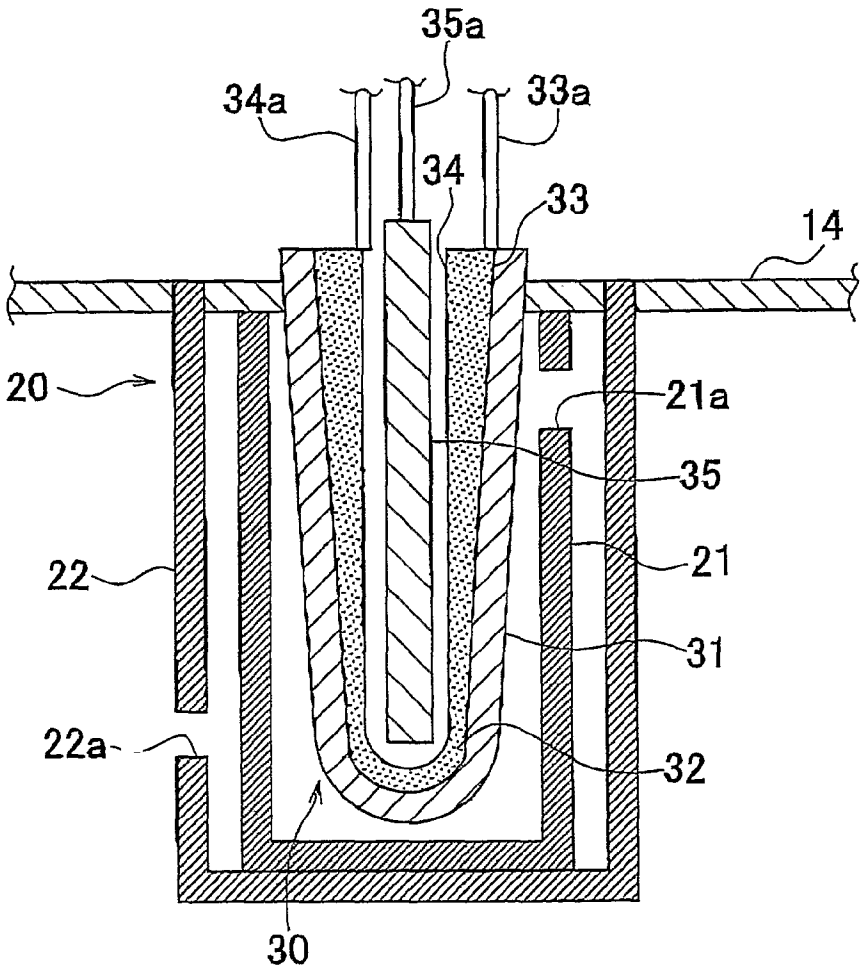
FIG. 2 is a cross-sectional view of an exhaust gas sensor controlled by the control system according to the first embodiment of the invention.

Referring to FIG. 2, the exhaust gas sensor 20 will be described in greater detail. FIG. 2 is a cross-sectional view of the exhaust gas sensor 20 according to the first embodiment of the invention. The exhaust gas sensor 20 has a sensor main body 30, an inner protective cover 21 disposed outside the sensor main body 30, and an outer protective cover 22 disposed outside the inner protective cover 21. A plurality of small vent holes 21*a* that allow entry of exhaust gases are provided in a side wall of the inner protective cover 21, and a plurality of small vent holes 22*a* are provided in a side wall of the outer protective cover 22, at locations opposite to the vent holes 21*a* with respect to the sensor main body 30.

The inner protective cover 21 and the outer protective cover 22 prevent the sensor main body 30 from directly contacting exhaust gases, so as to ensure thermal insulation of the sensor main body 30, and also prevent the sensor main body 30 from being directly exposed to condensed water that may collect in the exhaust pipe 14.

The sensor main body 30 consists principally of a diffusion resistance layer 31, a solid electrolyte layer 32 (sensor element), outer electrode layer 33, inner electrode layer 34, and the heater 35.

The diffusion resistance layer 31 is fixed in position such that an opening end portion of the diffusion resistance layer 31 is fitted in a hole of a wall of the exhaust pipe 14, and the solid electrolyte layer 32 is disposed inside and secured to the diffusion resistance layer 31. The solid electrolyte layer 32 is sandwiched between the outer electrode layer 33 and the inner electrode layer 34, and is secured to these electrode layers 33, 34. An electric wire 33*a* is connected to one end portion of the outer electrode layer 33, and an electric wire 34*a* is connected to one end portion of the inner electrode layer 34. A sensor circuit (not shown) is connected between the electric wire 33*a* and the electric wire 34*a*, and the voltage applied from the sensor circuit is placed between the outer electrode layer 33 and the inner electrode layer 34.

Once the solid electrolyte layer 32 is activated, current flowing between the outer electrode layer 33 and the inner electrode layer 34 changes in proportion to the oxygen concentration in the exhaust gas. The current that flows between the outer electrode layer 33 and the inner electrode layer 34 is measured, and the current value and the applied voltage value are transmitted to the ECU 9.

The heater 35, which increases the element temperature of the solid electrolyte layer 32 to the activation temperature, and keeps the thus activated solid electrolyte layer 32 in an active condition, is disposed in a space formed inside the solid electrolyte layer 32. When electric power is supplied to the heater 35 via an electric wire 35*a*, in accordance with a control signal from the ECU 9, the heater 35 heats the solid electrolyte layer 32.

As shown in FIG. 1, an exhaust gas temperature sensor 24 located immediately downstream of the casing 19 in the exhaust pipe 14 generates a signal corresponding to the temperature of exhaust gas flowing from the casing 19, and outputs the signal to the ECU 9. In addition, an outside air temperature sensor 25 is provided that generates a signal corresponding to the outside air temperature of the internal combustion engine, and outputs the signal to the ECU 9.

The ECU 9 includes ROM (read only memory), RAM (random-access memory), CPU (central processing unit), input ports and output ports. For example, the ECU 9 receives, signals from the air flow meter 5, the exhaust gas sensor 20, the exhaust gas temperature sensor 24, and the outside air temperature sensor 25 through the input ports. The ECU 9, in turn, outputs signals for controlling the respective fuel injection valves 10 and the EGR valve 17, and a signal for controlling the heater 35 of the exhaust gas sensor 20 through the output ports.

The ECU 9 performs basic control operations, such as control of the fuel injection amount of the engine 1, and also controls the energization of the heater 35 of the exhaust gas sensor 20 (i.e., controls power to be supplied to the heater 35), to activate the sensor element.

The ECU 9 functions as the condensed water amount estimating device, condensed water presence determining device, dryness determining device, and heating control device, in accordance with the present invention. The configuration and features of the ECU 9 of the internal combustion engine according to this embodiment of the invention will be described with reference to the drawings. The ECU 9 estimates the amount of condensed water in the exhaust pipe 14. Thus, the ECU 9 functions as the condensed water amount estimating device. Also, the ECU 9 determines whether the estimated amount of condensed water is present. Thus, the ECU 9 functions as the condensed water presence determining device. Also, the ECU 9 determines whether the interior of the exhaust pipe 14 is dry. Thus, the ECU 9 functions as the dryness determining device. In addition, the ECU 9 controls the amount of power that is supplied to the heater 35, and heats the exhaust gas sensor 20. Thus, the ECU 9 functions as the heating control device.

The exhaust gas temperature sensor 24 functions as the exhaust gas temperature sensing device according to the invention, and the air flow meter 5 functions as the air flow amount sensing device according to the invention, while the outside air temperature sensor 25 functions as the outside air temperature sensing device according to the invention.

Figure 3A:
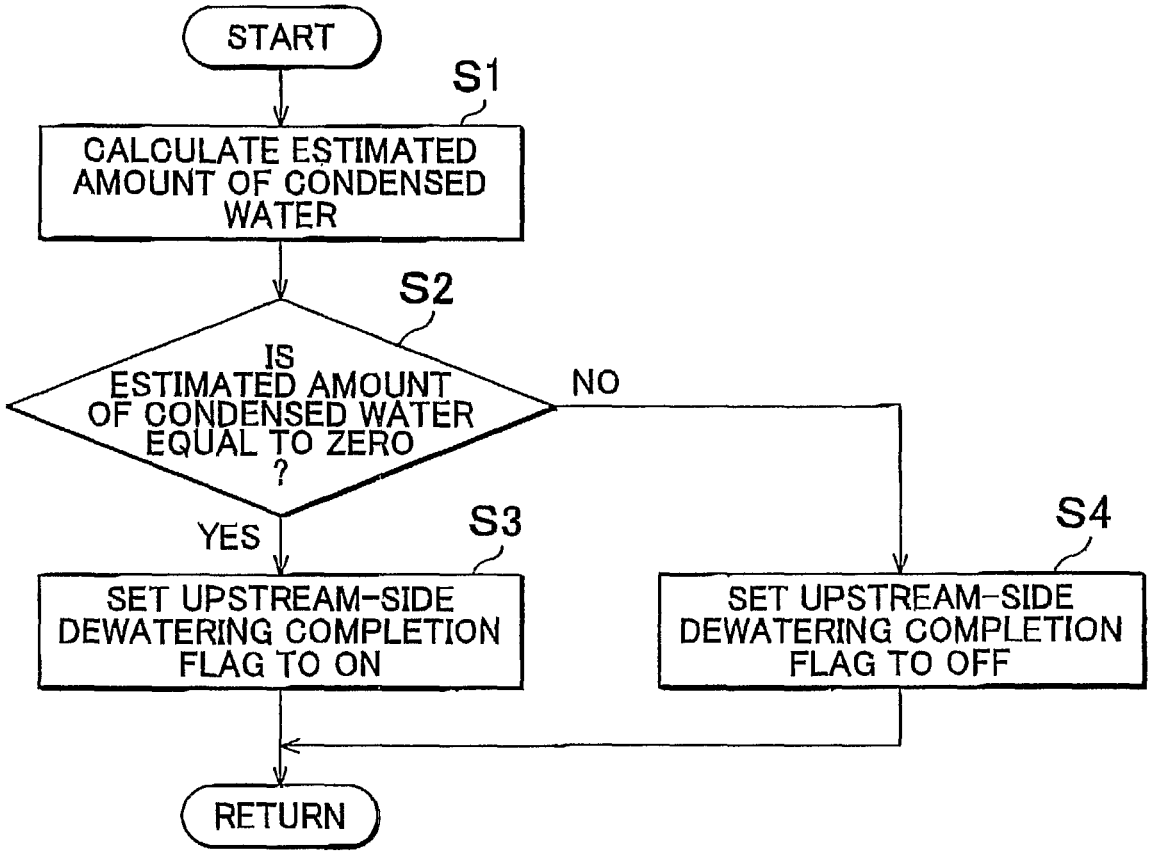
FIG. 3A is a flowchart concerning heating control of the exhaust gas sensor according to the first embodiment of the invention, more specifically, a flowchart concerning determination of whether condensed water is present in an exhaust pipe.
Figure 3B:
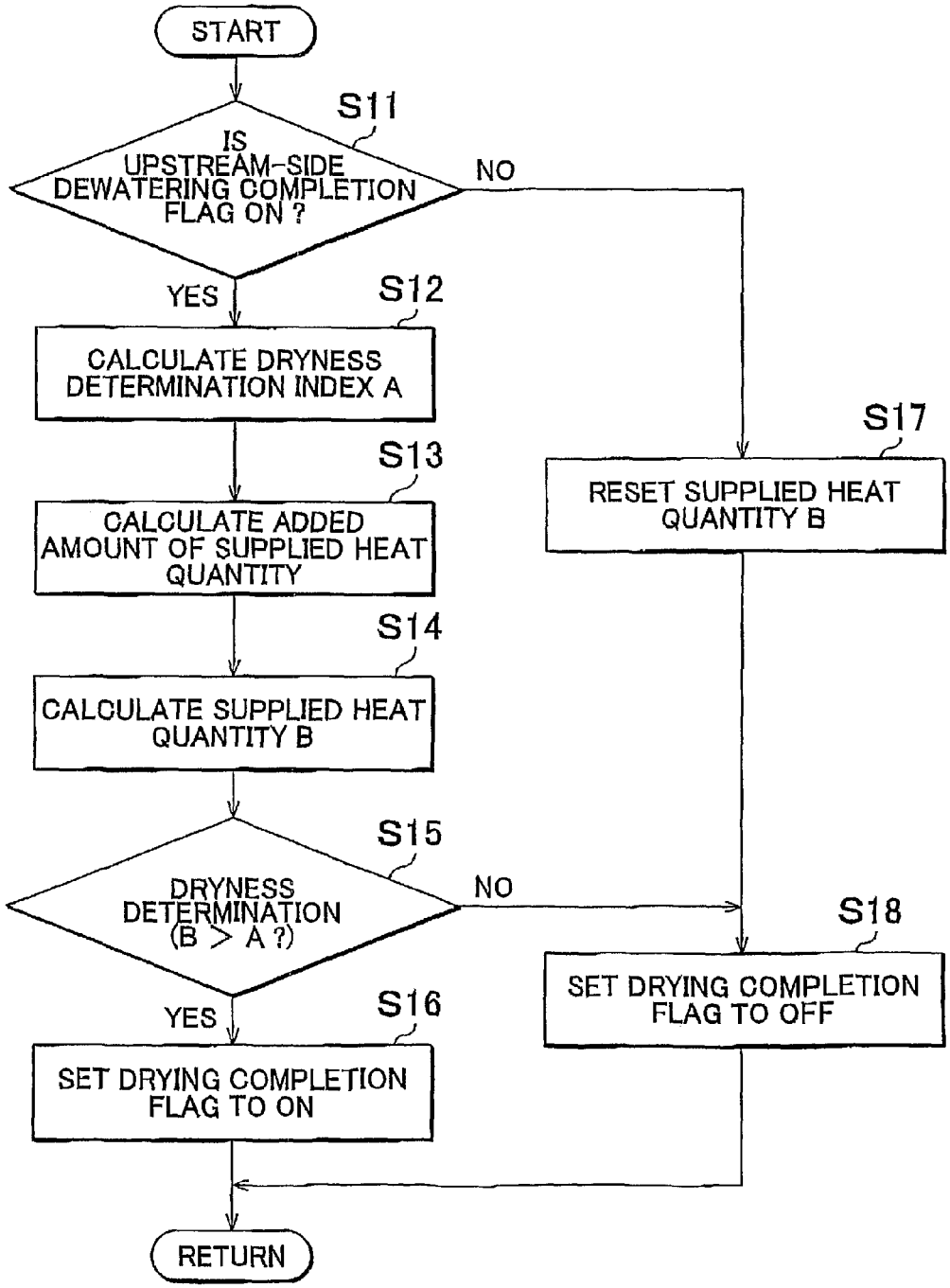
FIG. 3B is a flowchart concerning heating control of the exhaust gas sensor according to the first embodiment of the invention, more specifically, a flowchart of the process for determining whether the exhaust pipe is dry.
Figure 4:
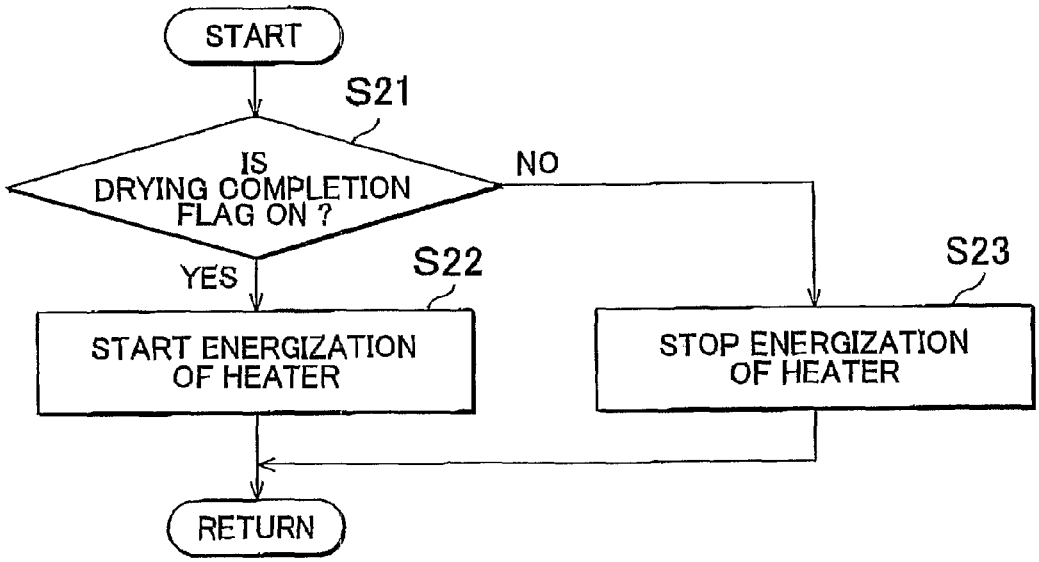
FIG. 4 is a flowchart concerning control of a heater of the exhaust gas sensor according to the first embodiment, when energized.

Next, the operation will be explained. In the following, the process of the heating control of the exhaust gas sensor 20 executed by the control system of the internal combustion engine according to the first embodiment of the invention will be explained. FIGS. 3A, 3B and FIG. 4 are flowcharts depicting heating control of the exhaust gas sensor 20 according to the first embodiment of the invention. FIG. 3A is a flowchart depicting the process of determining whether water has condensed in the exhaust pipe 14. FIG. 3B is a flowchart depicting the process of determining whether the exhaust pipe 14 is dry. FIG. 4 is a flowchart concerning control of the heater 35 of the exhaust gas sensor 20 when energized. The following explanation of the first embodiment of the invention is based on the assumption that condensed water collects upstream of the exhaust gas sensor 20.

The processes as illustrated in FIGS. 3A, 3B and FIG. 4 are executed by the CPU of the ECU 9, at specified time intervals after the engine 1 is started, and are implemented according to programs executable by the CPU. The specified time intervals mean, for example, intervals of several seconds or less.

Figure 5:
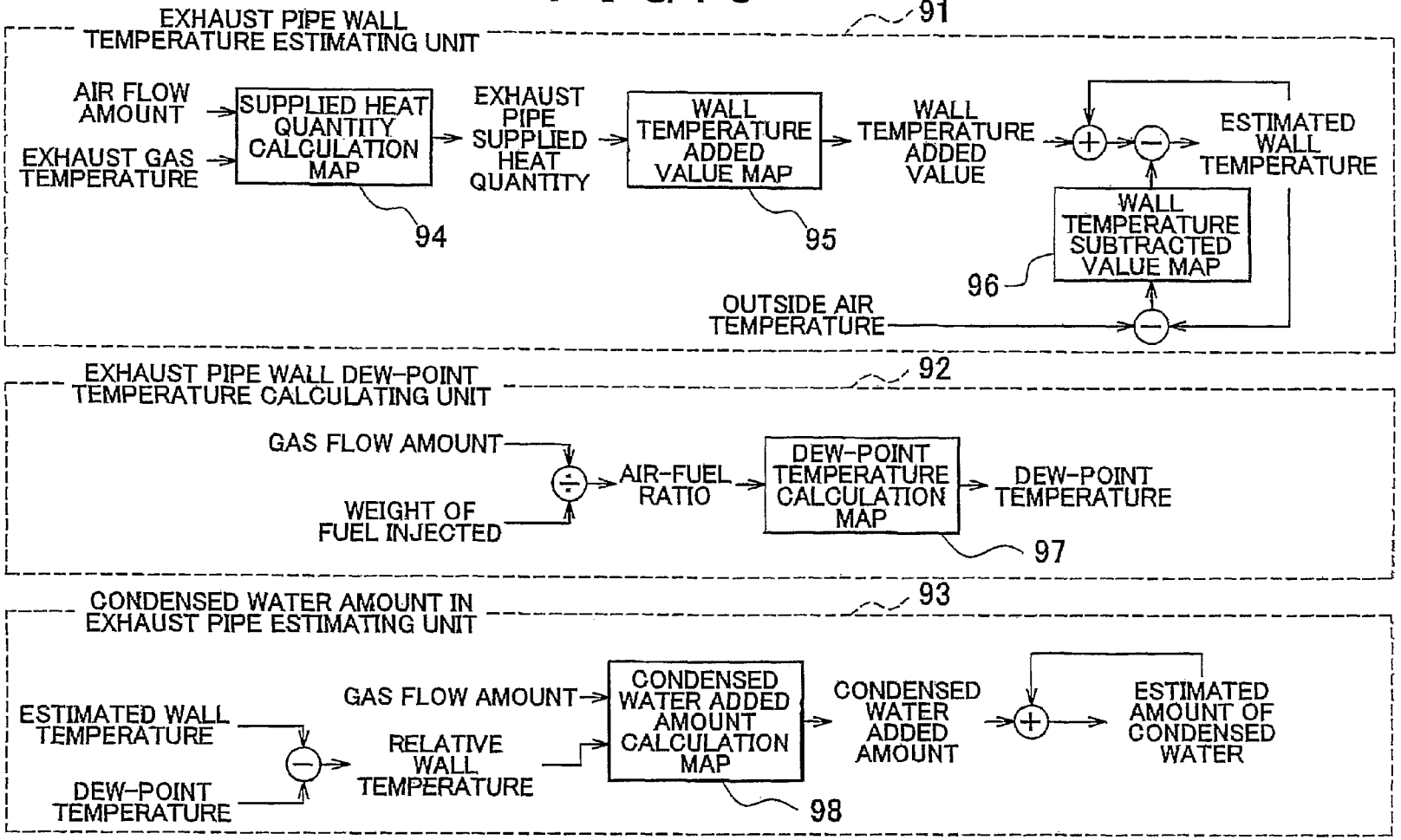
FIG. 5 is a control block diagram illustrating a condensed water amount estimating process according to the first embodiment of the invention

As shown in FIG. 3A, the ECU 9 determines whether water has condensed in the exhaust pipe 14 once the engine 1 is started, and estimates amount of condensed water (step S1). Here, the process for estimating the amount of condensed water that collects in the exhaust pipe 14 will be described in detail with reference to FIG. 5. FIG. 5 is a control block diagram representing the condensed water amount estimating process according to the first embodiment of the invention.

The condensed water amount estimating process is executed by an exhaust pipe wall temperature estimating unit 91, exhaust pipe wall dew-point calculating unit 92, and a condensed water amount estimating unit 93, and is executed according to a program. In estimating the condensed water amount, a supplied heat quantity calculation map 94, wall temperature added value (i.e. increase or decrease value) map 95, wall temperature subtracted value map 96, dew-point calculation map 97, and a condensed water added amount (i.e. increase or decrease amount) calculation map 98 are used. These maps may be stored in the ROM, or the like.

In the first embodiment of the invention, the wall temperature added value (i.e. increase value) map 95, wall temperature subtracted value (i.e. decrease value) map 96 and the condensed water added amount (i.e. increase or decrease amount) calculation map 98 are set so that condensed water that collects upstream of the exhaust gas sensor 20 may be estimated. The maps may also be set so that condensed water that collects downstream of the exhaust gas sensor 20 can be estimated, the use of the maps set in this manner will be explained in a second embodiment of the invention. While the same supplied heat quantity calculation map 94 and the dew-point calculation map 97 may be used in estimating the condensed water that collects upstream of the exhaust gas sensor 20 and downstream of the exhaust gas sensor 20, separate supplied heat quantity calculation maps 94 and dew-point calculation maps 97 may be used to estimate the upstream condensed water and the downstream condensed water. Also, these maps are set in accordance with the circumstances or conditions, such as the shape of the exhaust pipe 14, and are set so that it can be determined whether the vicinity of the exhaust gas sensor 20 is dry. Values obtained through experiments, or the like, are used as values set in these maps.

The exhaust pipe wall temperature estimating unit 91 estimates the temperature of the exhaust pipe wall, using the supplied heat quantity calculation map 94, wall temperature added value map 95, and the wall temperature subtracted value map 96. The supplied heat quantity calculation map 94 depicts the relationship between the air flow amount and exhaust gas temperature, and the quantity of heat that is supplied to the exhaust pipe. The wall temperature added value map 95 depicts the relationship between the quantity of heat supplied to the exhaust pipe, and a value to be added to the wall temperature. The wall temperature subtracted value map 96 depicts the relationship between the difference of the estimated wall temperature and the outside air temperature, and a value to be subtracted from the wall temperature.

For example, the relationship between the air flow amount and exhaust gas temperature, and the quantity of heat supplied to the exhaust pipe, as defined in the supplied heat quantity calculation map 94, is such that the quantity of heat supplied to the exhaust pipe tends to increase with increases in the air flow amount and/or the exhaust gas temperature. For example, the relationship between the quantity of heat supplied to the exhaust pipe and the value to be added to the wall temperature, as defined in the wall temperature added value map 95, is such that the value to be added to the wall temperature tends to increase as the quantity of heat supplied to the exhaust pipe increases. For example, the relationship between the difference of the estimated wall temperature and the outside air temperature, and the value to be subtracted from the wall temperature, as defined in the wall temperature subtracted value map 96, is such that the value to be subtracted from the wall temperature tends to increase as the difference increases.

Next, the process executed by the exhaust pipe wall temperature estimating unit 91 will be explained. The ECU 9 obtains the quantity of heat supplied to the exhaust pipe, which corresponds to the air flow amount measured by the air flow meter 5 and the exhaust gas temperature measured by the exhaust gas temperature sensor 24, with reference to the supplied heat quantity calculation map 94. The ECU 9 then obtains a value to be added to the wall temperature, which corresponds to the obtained quantity of heat supplied to the exhaust pipe, with reference to the wall temperature added value map 95.

Then, the ECU 9 obtains a value to be subtracted from the wall temperature, which corresponds to a value obtained by subtracting the outside air temperature detected by the outside air temperature sensor 25 from the estimated wall temperature calculated in the previous cycle, with reference to the wall temperature subtracted value map 96. The ECU 9 obtains an added value by adding the wall temperature added value obtained referring to the wall temperature added value map 95 to the estimated wall temperature calculated in the previous cycle, and sets the difference obtained by subtracting the wall temperature subtracted value obtained from the above-indicated added value, as the new or updated estimated wall temperature. For example, the outside air temperature detected by the outside air temperature sensor 25 is set as the initial value of the estimated wall temperature when the exhaust gas wall temperature estimating process is started.

The exhaust pipe wall dew-point calculating unit 92 calculates the dew-point of the wall of the exhaust pipe 14, using the dew-point calculation map 97. The dew-point calculation map 97 depicts the relationship between the air-fuel ratio and the dew-point. For example, the relationship between the air-fuel ratio and the dew-point is such that the dew-point tends to decrease as the air-fuel ratio increases.

Next, the process executed by the exhaust pipe wall dew-point calculating unit 92 will be explained. Initially, the ECU 9 calculates the air-fuel ratio, based on the ratio of the air flow amount measured by the air flow meter 5 to the weight of fuel injected by the fuel injection valves 10. Although the air-fuel ratio may be obtained from the result generated from the exhaust gas sensor 20, the air-fuel ratio is calculated using the air flow amount and the weight of the fuel injected, in view of a possibility that the exhaust gas sensor 20 has not been activated. The ECU 9 obtains a dew-point corresponding to the calculated air-fuel ratio, by referring to the dew-point calculation map 97.

The condensed water amount estimating unit 93 estimates the amount of condensed water in the exhaust pipe 14, using the condensed water added amount calculation map 98. The condensed water added amount calculation map 98 depicts the relationship between the air flow amount and relative wall temperature, and the added amount of condensed water. For example, the relationship between the air flow amount and relative wall temperature, and the added amount of condensed water is such that the added amount of condensed water tends to decrease as the air flow amount increases and/or as the relative wall temperature increases. Basically, the added amount of condensed water is a negative value if the air flow amount is larger than a reference amount and is a positive value if the air flow amount is smaller than the reference amount; however, the reference amount varies depending on the relative wall temperature.

Next, the process executed by the condensed water amount estimating unit 93 will be explained. Initially, the ECU 9 calculates a relative wall temperature as a difference between the estimated wall temperature estimated by the exhaust pipe wall temperature estimating unit 91, and the dew-point calculated by the exhaust pipe wall dew-point calculating unit 92. The ECU 9 then obtains an added amount of condensed water, which corresponds to the calculated relative wall temperature and the air flow amount measured by the air flow meter 5, and adds the obtained added amount of condensed water to the estimated amount of condensed water calculated in the last cycle, and sets the sum as a new or updated estimated condensed water amount. The condensed water added amount may be a positive or negative value, as described above, and is set to zero when the condensed water estimated amount is a negative value. The initial estimated amount of the condensed water, when the of the exhaust pipe wall dew-point process is started, will be described later.

As shown in FIG. 3A, the ECU 9 determines whether the estimated amount of condensed water calculated in step S1 is equal to zero, namely, whether there is no estimated amount of condensed water upstream of the exhaust gas sensor 20 in the exhaust pipe 14 (step S2). If there is no estimated amount of condensed water, the ECU 9 sets an upstream-side drying completion flag to ON (step S3). If the estimated amount of condensed water is not equal to zero, the ECU 9 sets the upstream-side drying completion flag to OFF (step S4). The information set with status of the upstream-side drying completion flag may be stored in the RAM.

While the ECU 9 determines whether condensed water is present in the exhaust pipe 14, a sensor may be provided to detect the actual amount of condensed water, and the presence or absence of condensed water may be determined by measuring the amount of water using this sensor, without estimating the amount of condensed water.

The ECU 9 also determines whether the exhaust pipe 14 is dry. As shown in FIG. 3B, the ECU 9 determines whether the upstream-side drying completion flag is set to ON (step S11). If the upstream-side drying completion flag is ON, the ECU 9 calculates a dryness determination index (step S12). In the following, the process of calculating the dryness determination index will be explained.

The dryness determination index is equal to the product of the exhaust pipe heat capacity and the outside air temperature correction factor (i.e., exhaust pipe heat capacity×outside air temperature correction factor). The exhaust pipe heat capacity is to dry the interior of the exhaust pipe 14 determined in advance corresponding to the structure of the exhaust pipe 14. Also, an outside air temperature correction factor map, which depicts the relationship between the outside air temperature and an outside air temperature correction factor, is stored in the ROM, or the like, and the ECU 9 obtains an outside air temperature correction factor corresponding to the outside air temperature measured by the outside air temperature sensor 25, by referring to the outside air temperature correction factor map. For example, the relationship between the outside air temperature and the outside air temperature correction factor, as defined in the outside air temperature correction factor map, is such that the outside air temperature correction factor tends to decrease as the outside air temperature increases.

Then, the ECU 9 calculates an amount to be added to the quantity of heat supplied from the engine 1 to the exhaust pipe 14 (step S13). More specifically, a supplied heat quantity added amount map, which depicts the relationship between the air flow amount and exhaust gas temperature, and the added amount, is stored in the ROM, or the like, and the ECU 9 obtains an added amount corresponding to the air flow amount measured by the air flow meter 5 and the exhaust gas temperature measured by the exhaust gas temperature sensor 24, by referring to the supplied heat quantity added amount map. For example, the relationship between the air flow amount and exhaust gas temperature, and the added amount, as defined in the supplied heat quantity added amount map, is such that the added amount tends to increase as the air flow amount and/or as the exhaust gas temperature increases. The added amount may be a positive or negative value.

Then, the ECU 9 adds the added amount calculated in step S13 to the supplied heat quantity calculated in the previous cycle, and sets the resulting value as the new or updated supplied heat quantity (step S14). Then, the ECU 9 determines whether the supplied heat quantity calculated in step S14 is larger than the dryness determination index calculated in step S12 (step S15).

If the supplied heat quantity B is larger than the dryness determination index A, the ECU 9 determines that the interior of the exhaust pipe 14 is dry, and sets a drying completion flag to ON (step S16). If the supplied heat quantity B is equal to or smaller than the dryness determination index A, the ECU 9 sets the drying completion flag to OFF (step S18). If it is determined in step S11 that the upstream drying completion flag is OFF, on the other hand, the ECU 9 initializes the supplied heat quantity to, for example, zero (step S17), and sets the drying completion flag to OFF in step S18.

As shown in FIG. 4, the ECU 9 also executes a control for controlling energization of the heater 35. Initially, the ECU 9 determines whether the drying completion flag is set to ON (step S21). If the drying completion flag is ON, the ECU 9 executes the energization control to allow electric current to be supplied to the heater 35 to activate the exhaust gas sensor 20 (step S22). If the heater 35 is energized at step S22, the ECU 9 continues the energization control. If the drying completion flag is OFF, on the other hand, the ECU 9 stops energization of the heater 35 (step S23). If energization is stopped, i.e., if the heater 35 is in a non-energized state at step S23, the ECU 9 maintains the heater 35 in the non-energized state.

As explained above, the vehicular control system according to the first embodiment of the invention estimates the amount of condensed water that collects in the exhaust pipe 14, using the exhaust gas temperature, the amount of air flow and the outside air temperature, and determines whether the estimated amount of condensed water is present in the exhaust pipe. Thus, the control system uses output values received from the air flow meter 5, exhaust gas temperature sensor 24 and the outside air temperature sensor 25, which are generally provided in the internal combustion engine, to determine whether condensed water is present, and the heater is powered to heat the exhaust gas sensor 20 when the system determines that condensed water is not present. Therefore, the control system does not require any apparatus or equipment for measuring the amount of condensed water that collects in the exhaust pipe 14, and the manufacturing cost associated with prevention of damage to the exhaust gas sensor 20 is sufficiently reduced. Also, the vehicular control system according to the first embodiment of the invention saves space because it does not require any apparatus for measuring the amount of condensed water present in the exhaust pipe 14.

Also, the vehicular control system according to the first embodiment of the invention determines whether condensed water has collected upstream of the exhaust gas sensor 20 in the exhaust pipe 14, and further determines whether the interior of the exhaust pipe 14 is dry if it determines that there is no condensed water. Thus, the control system determines whether water has condensed in the exhaust pipe with greater accuracy, and then causes the heater 35 to heat the exhaust gas sensor 20, based on the determination, thus preventing the exhaust gas sensor 20 from being damaged by any condensed water.

If the exhaust gas sensor 20, on which water droplets are deposited, is rapidly heated when the cooled engine is being started, the exhaust gas sensor 20 may possibly suffer cracking. Therefore, the exhaust gas sensor 20 is generally preheated so that water that has condensed on the sensor 20 evaporates. However, the vehicular control system according to the first embodiment of the invention does not require the preheating process because the heater 35 of the exhaust gas sensor 20 is powered to heat the sensor 20 only when the interior of the exhaust pipe 14 is dry.

In addition, the vehicular control system according to the first embodiment of the invention determines that the interior of the exhaust pipe 14 is dry if the quantity of heat B supplied to the exhaust pipe, which is the sum of the added amounts sequentially obtained using the exhaust gas temperature and the air flow amount, is larger than the dryness determination index A obtained from the outside air temperature and the predetermined heat capacity of the exhaust pipe. Thus, the vehicular control system of the first embodiment of the invention is able to easily determine whether the interior of the exhaust pipe 14 is dry, because it uses the output values of the air flow meter 5, exhaust gas temperature sensor 20 and the outside air temperature sensor 25, which are generally provided in the internal combustion engine.

In the meantime, even if the exhaust gas sensor 20 is in an activated condition, the temperature of exhaust gases may be lowered such as when the engine 1 idles for a long time, and condensed water may collect in the exhaust pipe 14, or the interior of the exhaust pipe 14 may become wet. Accordingly, the process of FIG. 3A for determining whether condensed water is present in the exhaust pipe 14, the process of FIG. 3B for determining whether the exhaust pipe 14 is dry, and the process of FIG. 4 for controlling energization of the heater 30 are executed all the time even if the exhaust gas sensor 20 is in an activated condition.

If the ignition switch is turned off so as to stop the engine 1, and the ignition switch is turned on again after a while, the estimated amount of condensed water obtained when when the ignition is switched off is set as the initial estimated amount of condensed water when the exhaust pipe wall dew-point calculating process is started. Also, if an event, such as cut-off of electric power supplied to the ECU 9, occurs, or if the engine 1 is stopped for a long period of time, the maximum estimated amount of condensed water that can collect in the exhaust pipe 14 is set as the initial estimated amount of condensed water.

Figure 6:
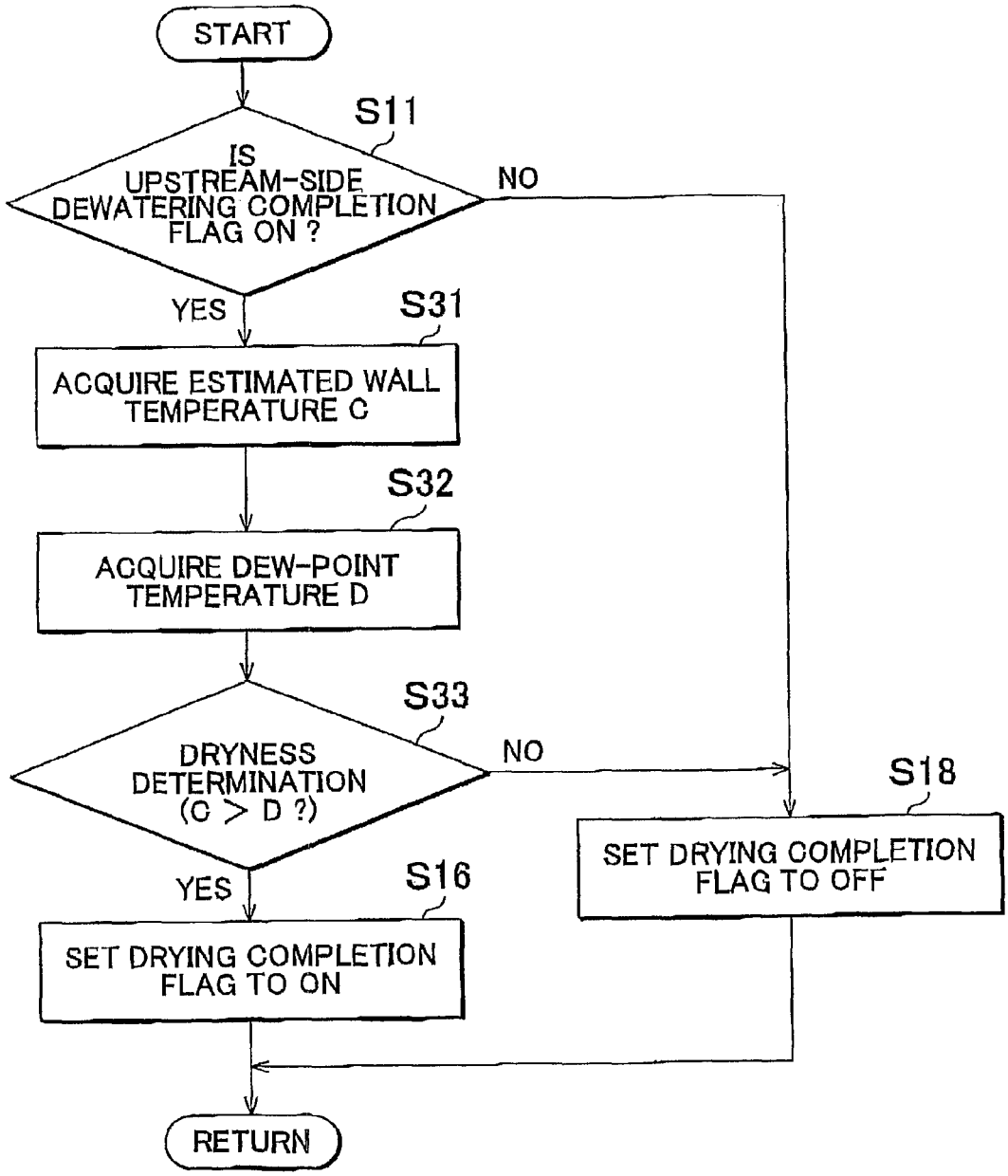
FIG. 6 is a flowchart of an alternative process for determining whether the exhaust pipe is dry.

The process of FIG. 3B for determining whether the exhaust pipe 14 is dry may be replaced with the process as shown in FIG. 6. FIG. 6 is a flowchart of an alternative process for determining whether the exhaust pipe 14 is dry. In the following, the process as shown in FIG. 6 will be explained.

Initially, the ECU 9 determines whether the upstream-side drying completion flag is set to ON (step S11). If the upstream-side drying completion flag is ON, the ECU 9 acquires the estimated wall temperature calculated by the exhaust pipe wall temperature estimating unit 91 (step S31), and acquires the dew-point calculated by the exhaust pipe wall dew-point calculating unit 92 (step S32).

Then, the ECU 9 determines whether the estimated wall temperature C acquired in step S31 is higher than the dew-point D acquired in step S32 (step S33). If the ECU 9 determines that the estimated wall temperature C is above the dew-point D, the ECU 9 assumes that the interior of the exhaust pipe 14 is dry, and sets the drying completion flag to ON (step S16). If the estimated wall temperature C is equal to or below the dew-point D, the ECU 9 sets the drying completion flag OFF (step S18). If, on the other hand, the upstream-side drying completion flag is OFF at step S11, the ECU 9 sets the drying completion flag OFF in step S18.

The vehicular control system according to the above-described modified embodiment determines that the interior of the exhaust pipe is dry if the estimated exhaust pipe wall temperature, which is sequentially obtained using the exhaust gas temperature, air flow amount and the outside air temperature, is above the dew-point of the exhaust pipe, which is determined based on the air-fuel ratio. Thus, the control system is able to accurately determine whether the exhaust pipe 14 is dry, based on the dew-point.

Next, a second embodiment of the invention will be described. While the amount of condensed water that collects upstream of the exhaust gas sensor 20 is estimated in the first embodiment, condensed water may also collect downstream of the exhaust gas sensor 20, depending on the shape of the exhaust pipe 14 downstream of the exhaust gas sensor 20. If condensed water collects downstream of the exhaust gas sensor 20, the downstream condensed water may spill on the exhaust gas sensor 20 when the vehicle moves backward, or when the brakes are abruptly applied. Therefore, the second embodiment of the invention is arranged to estimate condensed water that collects downstream as well as upstream of the exhaust gas sensor 20.

The construction of the internal combustion engine of the vehicle according to the second embodiment of the invention is similar to that of the internal combustion engine of the vehicle according to the first embodiment of the invention, and therefore will not be described in detail. The same reference numerals as used in the first embodiment will be used for explaining the construction of the internal combustion engine of the vehicle according to the second embodiment of the invention.

In the following, a heating control of the exhaust gas sensor 20, which is executed by a control system of the internal combustion engine according to the second embodiment of the invention, will be described. In the second embodiment of the invention, condensed water that collects upstream of the exhaust gas sensor 20 is estimated while a dryness determination is made, and, in addition, condensed water that collects downstream of the exhaust gas sensor 20 is estimated.

Figure 7:
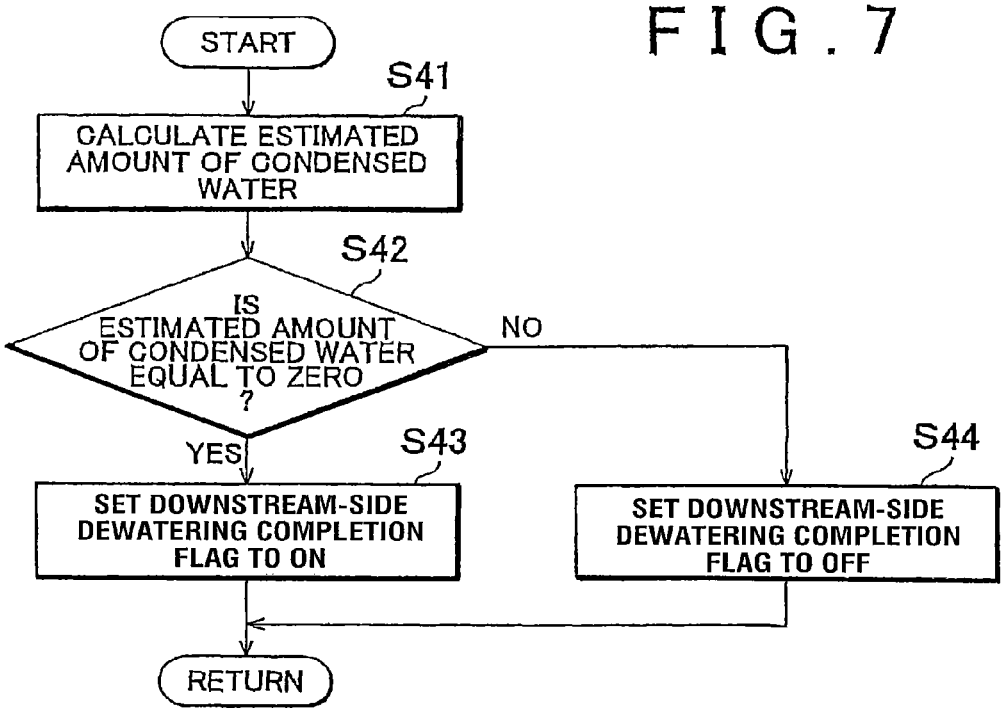
FIG. 7 is a flowchart concerning determination of whether condensed water has collected downstream of the exhaust gas sensor.
Figure 8:
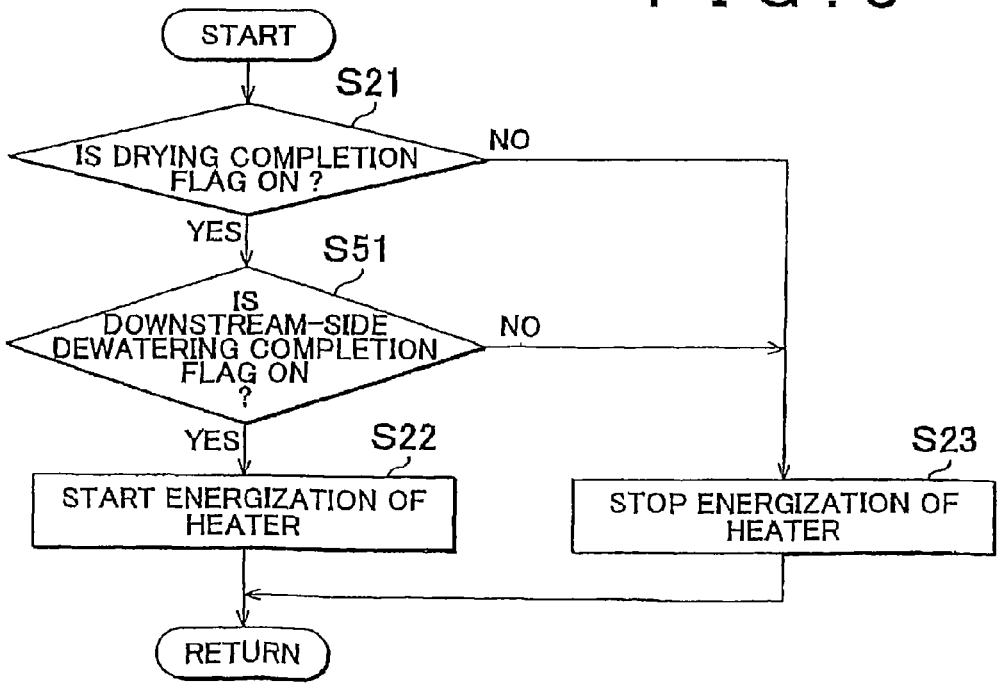
FIG. 8 is a flowchart concerning control of the heater of the exhaust gas sensor when energized, according to a second embodiment of the invention.

FIGS. 3A, 3B are flowcharts of the process of determining whether condensed water has collected upstream of the exhaust gas sensor 20, and of the process of determining whether the exhaust pipe 14 is dry. FIG. 7 is a flowchart of the process of determining whether condensed water has collected downstream of the exhaust gas sensor 20. FIG. 8 is a flowchart of a control of an energized state of the heater 35 of the exhaust gas sensor 20.

The processes as illustrated in FIGS. 3A, 3B, FIG. 7 and FIG. 8 are executed by the ECU 9, at specified time intervals, and are implemented by programs that are processed by the CPU. The above-indicated time intervals mean time intervals of several seconds or shorter.

The processes of the flowcharts as shown in FIGS. 3A and 3*b*, which are concerned with the determination of whether water has condensed in the exhaust pipe 14 upstream of the exhaust gas sensor 20 and the determination of whether the exhaust pipe 14 is dry, have been explained in connection with the first embodiment of the invention, and therefore will not be explained below.

Next, as shown in FIG. 7, the ECU 9 estimates the amount of condensed water present in the exhaust pipe 14 and calculates the estimated amount of condensed water, during starting of the engine 1 or at any time after start of the engine 1 (step S41). Here, the process for estimating the amount of condensed water that collects in the exhaust pipe 14 is similar to the condensed water amount estimating process as explained with reference to FIG. 5.

While the wall temperature added value map 95, wall temperature subtracted value map 96 and the condensed water added amount calculation map 98, as explained with reference to FIG. 5, are used for estimating the amount of condensed water that collects upstream of the exhaust gas sensor 20, these maps are substituted with a different wall temperature added value map, wall temperature subtracted map, and condensed water added amount calculation map are used to estimate the amount of water that has condensed downstream of the exhaust gas sensor 20 in step S41. These maps are stored in the ROM, or the like, and output values that match the shape and other features of a downstream portion of the exhaust pipe 14 are set in the maps for estimating the amount of water that has condensed downstream of the exhaust gas sensor.

As shown in FIG. 7, the ECU 9 determines whether the estimated amount of condensed water calculated in step S41 is equal to zero, namely, whether the estimated amount of condensed water present downstream of the exhaust gas sensor 20 in the exhaust pipe 14 is equal to zero (step S42). If the estimated amount of condensed water is equal to zero, the ECU 9 sets a downstream-side drying completion flag to ON (step S43). If the estimated amount of condensed water is not equal to zero (i.e., greater than zero), the ECU 9 sets the downstream-side drying completion flag to OFF (step S44). The downstream drying completion flag is stored in the RAM.

Because exhaust gas flows from the upstream side of the exhaust gas sensor 20 to the downstream side thereof, the dryness determining process is performed only with respect to the upstream side of the exhaust gas sensor 20.

The ECU 9 also executes a control for controlling energization of the heater 35 of the exhaust gas sensor 20, as shown in FIG. 8. Initially, the ECU 9 determines whether the drying completion flag is set to ON (step S21). If the drying completion flag is ON, the ECU 9 determines whether the downstream-side drying completion flag is set to ON (step S51).

If the drying completion flag and the downstream-side drying completion flag are both ON, the ECU 9 allows electric current to be supplied to the heater 35 to start heating by the heater 35, and controls the energization of the heater 35 so as to activate the exhaust gas sensor 20 (step S22). If the heater 35 is energized at step S22, the ECU 9 continues to execute the energization control.

However, if either of the drying completion flag and the downstream-side drying completion flag is OFF, the ECU 9 stops energization of the heater 35 (step S23). If energization has already been stopped, namely, if the heater 35 is in a non-energized state at step S23, the ECU 9 maintains the heater 35 in the non-energized state.

As explained above, the vehicular control system according to the second embodiment of the invention determines whether condensed water has collected downstream of the exhaust gas sensor 20 in the exhaust pipe 14, as well as whether condensed water has collected upstream of the exhaust gas sensor 20, and further determines whether the interior of the exhaust pipe 14 is dry if it determines that there is no condensed water. Thus, the control system more accurately determines whether condensed water is present, and causes the heater 35 to heat the exhaust gas sensor 20 based on the determination, thus preventing the exhaust gas sensor 20 from being damaged.

As explained above, the vehicular control system according to the second embodiment of the invention uses output values of the exhaust gas temperature sensor 24, air flow meter 5 and the outside air temperature sensor 25, which are generally provided in the engine, to estimate the amount of condensed water that collects in the exhaust pipe, using the exhaust gas temperature, the amount of air flow and the outside air temperature, and determine the presence or absence of the estimated condensed water. If it is determined that there is no condensed water, the control system further determines whether the interior of the exhaust pipe 14 is dry, thus assuring improved accuracy in determining whether condensed water is present. Because the heater of the exhaust gas sensor 20 is powered to heat the sensor 20 based on the above determination, the exhaust gas sensor 20 is reliably prevented from being damaged, without requiring any apparatus or equipment that measures the amount of condensed water present in the exhaust pipe 14, and the manufacturing cost associated with prevention of damage to the sensor 20 can be sufficiently reduced. Thus, the present invention is useful for vehicular control systems, in general, which execute the heating control of the heater 35.

The invention claimed is:

1. An exhaust gas sensor control system that controls energization of a heater that heats an exhaust gas sensor provided in an exhaust pipe of an internal combustion engine, the exhaust gas sensor control system comprising:

an exhaust gas temperature sensor that detects an exhaust gas temperature of exhaust gas in the exhaust pipe;

an air flow amount sensor that detects an air flow amount of air that is drawn into the internal combustion engine;

an outside air temperature sensor that detects an outside air temperature; and at least one ECU programmed to function as:

a condensed water amount estimating device that estimates an amount of condensed water that collects in the exhaust pipe using the exhaust gas temperature detected by the exhaust gas temperature sensor when the internal combustion engine is started, the air flow amount measured by the air flow amount sensor, and the outside air temperature detected by the outside air temperature sensor;

a condensed water presence determining device that determines from the amount of condensed water estimated by the condensed water amount estimating device whether or not condensed water is present in the exhaust pipe; and a heater control device that supplies electric current to the heater if the condensed water presence determining device determines that there is no condensed water present in the exhaust pipe, wherein the condensed water amount estimating device calculates an estimated exhaust pipe wall temperature in the exhaust pipe, which is sequentially obtained using the exhaust gas temperature, the air flow amount, and the outside air temperature; calculates a dew-point of the exhaust pipe, which is determined based on an air-fuel ratio as a ratio of the air flow amount to the weight of fuel; obtains a relative exhaust pipe wall temperature based on the estimated exhaust pipe wall temperature and the dew-point; calculates a condensed water added amount based on the relative exhaust pipe wall temperature and the air flow amount; and estimates the amount of condensed water by summing the calculated condensed water added amount the condensed water amount estimating device estimates the amount of condensed water present upstream and downstream of the exhaust gas sensor in the exhaust pipe, the condensed water presence determining device determines whether the amount of condensed water estimated by the condensed water amount estimating device is present upstream of and downstream of the exhaust gas sensor, and a plurality of maps utilized to estimate the amount of condensed water present upstream of the exhaust gas sensor are different than those utilized to estimate the amount of condensed water present downstream of the exhaust gas sensor.

2. The exhaust gas sensor control system according to claim 1, wherein the at least one ECU is further programmed to function as:

a dryness determining device that determines whether the interior of the exhaust pipe is dry, using the detected exhaust gas temperature, the detected air flow amount, and the detected outside air temperature, if the condensed water presence determining device determines that there is no condensed water, wherein the heating control device supplies electric current to the heater if it is determined that there is no condensed water and the drying determining device determines that the interior of the exhaust pipe is dry.

3. The exhaust gas sensor control system according to claim 2, wherein the dryness determining device determines that the interior of the exhaust pipe is dry if a quantity of heat supplied to the exhaust pipe, which is a sum of added quantities sequentially obtained using the exhaust gas temperature and the air flow amount, exceeds a dryness determination index calculated based on the detected outside air temperature and a predetermined heat capacity of the exhaust pipe.

4. The exhaust gas sensor control system according to claim 2, wherein the dryness determining device determines that the interior of the exhaust pipe is dry if an estimated exhaust pipe wall temperature of the exhaust pipe, which is sequentially obtained using the exhaust gas temperature, the air flow amount, and the outside air temperature; is above a dew-point of the exhaust pipe, which is obtained based on an air-fuel ratio of the air flow amount to the weight of fuel.

5. The exhaust gas sensor control system according to claim 2, wherein the condensed water presence determining device determines whether water has condensed in a portion of the exhaust pipe upstream of the exhaust gas sensor.

6. The exhaust gas sensor control system according to claim 5, wherein the condensed water presence determining device determines whether water has condensed in the exhaust pipe upstream and downstream of the exhaust gas sensor.

7. The exhaust gas sensor control system according to claim 1, wherein the relative exhaust pipe wall temperature is a difference between the estimated exhaust pipe wall temperature and the dew-point.

8. An exhaust gas sensor control method for controlling the energization of a heater that heats an exhaust gas sensor provided in an exhaust pipe of an internal combustion engine, the exhaust gas sensor control method comprising:

detecting an exhaust gas temperature of exhaust gas in the exhaust pipe;

detecting an air flow amount that is drawn into the internal combustion engine;

detecting an outside air temperature;

estimating an amount of condensed water that collects in the exhaust pipe using the exhaust gas temperature detected when the internal combustion engine is started, the detected air flow amount, and the detected outside air temperature including estimating the amount of condensed water present upstream and downstream of the exhaust gas sensor in the exhaust pipe;

determining from the estimated amount of condensed water whether or not condensed water is present in the exhaust pipe including determining whether the estimated amount of condensed water is present upstream of and downstream of the exhaust gas sensor; and supplying electric current to the heater if it is determined that there is no condensed water present in the exhaust pipe, wherein the estimating the amount of condensed water includes:

calculating an estimated exhaust pipe wall temperature in the exhaust pipe, which is sequentially obtained using the detected exhaust gas temperature, the detected air flow amount, and the detected outside air temperature, calculating a dew-point of the exhaust pipe, based on an air-fuel ratio as a ratio of the air flow amount to the weight of fuel, obtaining a relative exhaust pipe wall temperature based on the estimated exhaust pipe wall temperature and the dew-point, calculating a condensed water added amount based on the relative exhaust pipe wall temperature and the air flow amount, and estimating the amount of condensed water by summing the calculated condensed water added amounts, and a plurality of maps utilized in estimating the amount of condensed water present upstream of the exhaust gas sensor are different than those utilized to estimate the amount of condensed water present downstream of the exhaust gas sensor.

9. The exhaust gas sensor control method according to claim 8, further comprising:

determining whether the interior of the exhaust pipe is dry, using the measured exhaust gas temperature, the detected air flow amount, and the measured outside air temperature, if it is determined that there is no condensed water; and supplying electric current to the heater if it is determined that there is no condensed water and the interior of the exhaust pipe is dry.

10. The exhaust gas sensor control method according to claim 9, wherein it is determined that the interior of the exhaust pipe is dry if a quantity of heat supplied to the exhaust pipe, which is a sum of added quantities sequentially obtained using the exhaust gas temperature and the air flow amount, exceeds a dryness determination index calculated based on the detected outside air temperature and a predetermined heat capacity of the exhaust pipe.

11. The exhaust gas sensor control method according to claim 9, wherein it is determined that the interior of the exhaust pipe is dry if an estimated exhaust pipe wall temperature of the exhaust pipe, which is sequentially obtained using the exhaust gas temperature, the air flow amount, and the outside air temperature, is above a dew-point of the exhaust pipe, which is obtained based on an air-fuel ratio of the air flow amount to the weight of fuel.

12. The exhaust gas sensor control method according to claim 9, further comprising:

determining whether water has condensed in a portion of the exhaust pipe upstream of the exhaust gas sensor.

13. The exhaust gas sensor control method according to claim 12, further comprising:

determining whether water has condensed in the exhaust pipe upstream and downstream of the exhaust gas sensor.

14. The exhaust gas sensor control method according to claim 8, wherein the relative exhaust pipe wall temperature is a difference between the estimated exhaust pipe wall temperature and the dew-point.

* * * * *